United States Patent [19]

Gidlund

[11] 4,305,473

[45] Dec. 15, 1981

[54] POWER CONTROL DEVICE FOR PNEUMATIC MOTORS

[75] Inventor: Per. A. L. Gidlund, Täby, Sweden

[73] Assignee: Atlas Copco Aktiebolag, Nacka, Sweden

[21] Appl. No.: 948,247

[22] Filed: Oct. 3, 1978

[30] Foreign Application Priority Data

Oct. 17, 1977 [SE] Sweden ..... 7711652

[51] Int. Cl.[3] ..... B25D 9/06; B25D 9/26

[52] U.S. Cl. ..... 173/16; 173/136

[58] Field of Search ..... 173/16, 17, 136

[56] References Cited

U.S. PATENT DOCUMENTS

| | | | |
|---|---|---|---|
| 707,735 | 8/1902 | Vaughan | 173/16 |
| 887,095 | 5/1908 | Johnson | 173/16 |
| 1,205,140 | 11/1916 | App | 173/16 |
| 3,739,862 | 6/1973 | Gunning | 173/16 |
| 4,074,777 | 2/1978 | Andersson et al. . | |

FOREIGN PATENT DOCUMENTS

| | | | |
|---|---|---|---|
| 2535106 | 2/1976 | Fed. Rep. of Germany | 173/136 |
| 334108 | 8/1930 | United Kingdom | 173/16 |

*Primary Examiner*—Robert Mackey

*Attorney, Agent, or Firm*—Frishauf, Holtz, Goodman and Woodward

[57] ABSTRACT

A power control device for a pneumatic motor includes a pressure air supply flow limiting means in the form of a flow restriction having a diverging, pressure recovering outlet. The device also comprises a load responsive pressure relief means which is located downstream of the flow restriction and which is arranged to gradually release pressure air from the motor into the atmosphere in response to decreasing load applied on the motor. The device is effective in reducing the motor power in response to decreasing load upon the motor. The disclosed motor is a hammer piston impact tool, and the motor load responsive pressure release means comprises the forward end of the motor cylinder and passages on a thrust sleeve which receives the shank of a chisel and which is slidingly received in the cylinder. A motor load balancing spring is arranged to bias the motor load responsive pressure relief valve toward its open position, such that, upon increasing motor load, the spring yields and permits the motor load responsive pressure relief valve to move toward its closed position.

14 Claims, 5 Drawing Figures

POWER CONTROL DEVICE FOR PNEUMATIC MOTORS

BACKGROUND OF THE INVENTION

This invention relates to a power control device for pneumatic motors.

In particular, the invention relates to a power control device of the type including an air supply flow limiting means.

The main object of the invention is to solve the problem of how to control the power of a pneumatic motor in response to the load applied on the motor. More specifically, the invention intends to accomplish a control device by which the motor power is reduceable in response to decreasing motor load.

Further, the invention intends to create a power control device by which the power developed by a pneumatic motor at idle running is effectively reduced.

The immediate advantage gained by such a device is that the motor is effectively protected against self-destruction. A further advantage is that a reduced air consumption is obtained at idle running.

DETAILED DESCRIPTION

Figure 1:
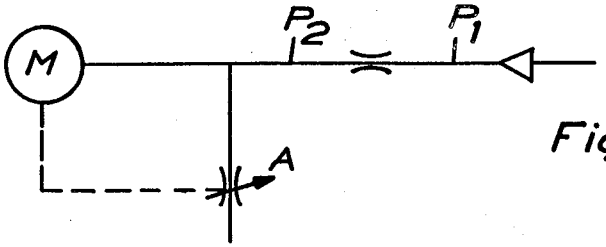
FIG. 1 shows schematically the motor power control device according to the invention.

As illustrated in FIG. 1, the power control device according to the invention comprises a flow limiting means located in the pressure air supply passage of a pneumatic motor M. The flow limiting means is a restriction provided with a diverging, pressure recovering outlet. The air pressure before the restriction is $P_1$ and the pressure after the restriction is $P_2$.

Downstream of the pressure recovering air supply restriction, there is a motor load responsive pressure relief or release means A which is coupled to the motor being controlled. The motor load responsive pressure relief or release means communicates with the atmosphere and is adjustable in response to the load applied on the motor in such a way as to increase its outlet area to the atmosphere in response to decreasing motor load.

Figure 2:
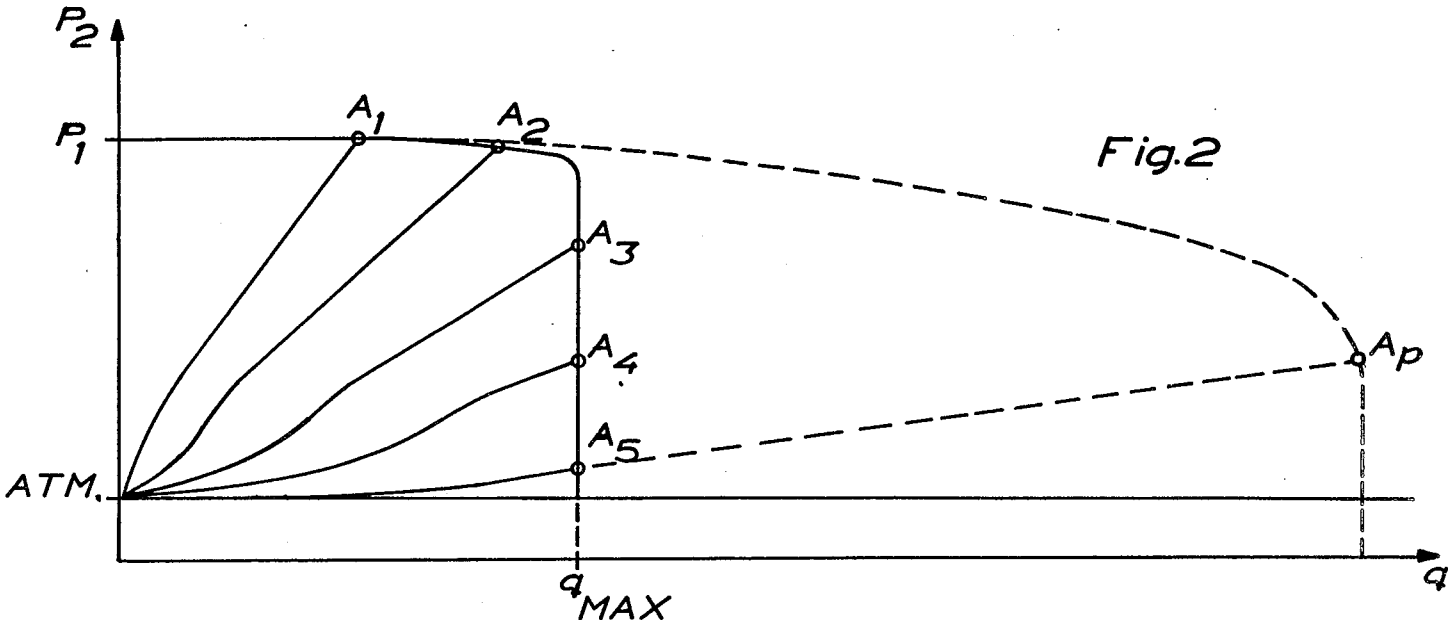
FIG. 2 shows a diagram in which the operation characteristics of the motor as well as the pressure drop-air flow relationship of the air supply flow restriction is illustrated.
Figure 3:
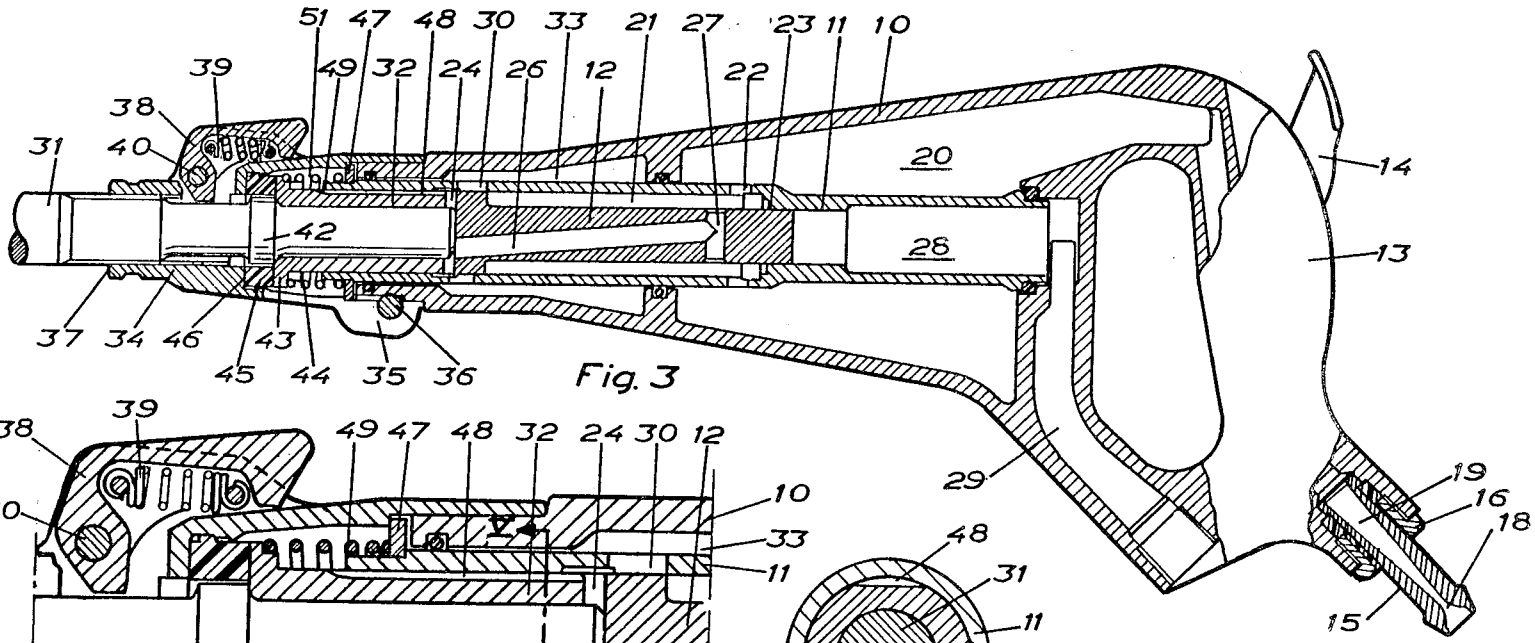
FIG. 3 shows a longitudinal section through a pneumatic tool including a power control device according to the invention.
Figure 5:
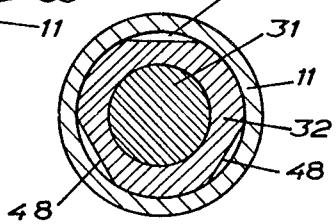
FIG. 5 shows a cross section taken along line V—V in FIG. 4.

In FIG. 2, there is shown the relationship between the pressure, $P_2$, downstream of the pressure recovering restriction and the air flow q passing through the restriction. In FIG. 2, there is also shown, in dash line, the relationship between the flow q and the downstream pressure $P_2$ at a flow restriction lacking pressure recovering properties. Whereas the latter allows a very large flow to pass at decreasing downstream pressure $P_2$, the pressure recovering restriction interrupts the flow increase very drastically. The reason is that, in the pressure recovering restriction, critical flow velocity is reached at a much lower pressure drop, and as soon as critical flow velocity is reached, the flow stops to increase.

In the diagram in FIG. 2, there is also illustrated the operation condition of the motor in response to variations in the outlet area of the pressure release valve A. The curve, starting at atmospheric pressure and ending at point $A_1$, represents the full power condition of the motor M which means that pressure release valve A is fully closed. As the load on the motor decreases, the area of the pressure release valve is successively increased, and the operation condition of the motor is changed from $A_1$ to $A_2$ to $A_3$ to $A_4$ and finally to $A_5$. At point $A_5$, the motor is idling.

As a result of the control action accomplished by the device according to the invention, the motor is idling at a very low pressure, thereby developing a low energy.

In order to illustrate to what extent the pressure recovering restriction contributes to the efficiency of the control device, the curve showing the $P_2$/q-relationship at fully opened pressure release valve, point $A_5$, is prolonged in dash line to meet at point $A_p$ the dash line curve representing $P_2$/q-relationship of an ordinary restriction lacking pressure recovering properties. The differences between the points $A_p$ and $A_5$ means a several times reduction of the air consumption as well as of the pressure $P_2$ when using a pressure recovering restriction.

In the tool shown in FIGS. 3 to 5, 10 designates a housing, 11 a motor cylinder mounted in the housing 10 and 12 a motor piston reciprocably powered in the cylinder 11. In its rear end, the housing 10 is formed with a handle 13 in which there is lodged a pressure air supply valve (not shown) controlled by a trigger 14.

Upstream of the supply valve, there is a nipple 15 for connection of a pressure air supply hose, (not shown). The nipple 15 is secured in the tool handle 13 by means of a threaded socket 16. The nipple 15 has an internal cross section which forms a flow restriction which is adapted to be dominant over the entire supply passage of the tool. The nipple 15 comprises a small cross section part 18 and a smoothly diverging, funnel shaped discharge part 19. The nipple 15, thereby, form a Venturi nozzle.

The pneumatic motor of the disclosed tool is further characterized by a pressure air supply chamber 20 which continuously communicates with a rear cylinder chamber 21 via openings 22 in the cylinder 11. The pressure air to chamber 20 is controlled by a pressure air supply valve (not shown) which in turn is controlled by trigger 14. The rear cylinder chamber 21 is an annular chamber defined by the piston 12 and a shoulder 23 in the cylinder 11.

In front of the piston 12, there is a forward cylinder chamber 24 which is intermittently pressurized via a longitudinal passage 26 in the piston 12. Via a transverse bore 27, the passage 26 alternatively connects the forward cylinder chamber 24 to the rear continuously pressurized chamber 21 and to an exhaust chamber 28 which is situated behind the shoulder 23 and which continuously communicates with the atmosphere via a passage 29. The hammer piston 12 is reciprocated in the cylinder 11 by intermittently connecting the forward large cross section end of the piston 12 to the pressure air source, and, between the intermittent connections to the pressure air source, depressurizing the forward large cross section piston end by connecting it to the atmosphere via exhaust chamber 28 and passage 29. This operation is achieved by conducting pressure air through passages 26 and 27 in the piston. When in the position shown in FIG. 3, the forward chamber 24 is pressurized via air supply 20, openings 22, chamber 21, bore 27 and passage 26. This moves the piston to the right, and when the bore 27 registers with exhaust chamber 28, the pressure in forward chamber 24 is released, thereby depressurizing the forward end of the piston.

The forward cylinder chamber 24 is defined by the piston 12 and the rear ends of a working tool 31 and a thrust sleeve 32. The latter surrounds the working tool 31 and is slidably fitted in the forward end of the cylinder 11. The chamber 24 also communicates with a pulsation chamber 33 via radial openings 30 in the cylinder 11.

The tool housing 10 comprises a front part 34 which, at its rear end, is formed with a slot 35 and which is clamped on the housing 10 by means of a transversely directed bolt 36. The front part 34 has a front opening 37 through which the rear end of the working tool 31 is received. On the front part 34, there is pivotably supported a tool retainer 38 which is loaded by a spring 39 toward its locking position. The tool retainer 38 is pivotable about a pin 40.

The working tool 31 is provided with an annular shoulder 42 by which it is axially supported against the thrust sleeve 32. The latter is at its forward end formed with a radial flange 43 by which it is axially clamped between a compression spring 44 and a resilient ring 45. The latter is inserted as a vibration absorbing means between the flange 43 of the thrust sleeve 32 and an internal shoulder 46 of the front part 34.

The spring 44 acts between the flange 43 of the thrust sleeve 32 and a lock ring 47. The latter is engaged by oppositely facing shoulders on the front part 34 of the housing and the motor cylinder 11, respectively. The lock ring 47 thereby locks the cylinder 11 against axial movement. The thrust sleeve 32 and the working tool 31 are axially displaceable against the action of the spring 44 as a result of a forwardly directed load applied on the housing 10.

Figure 4:
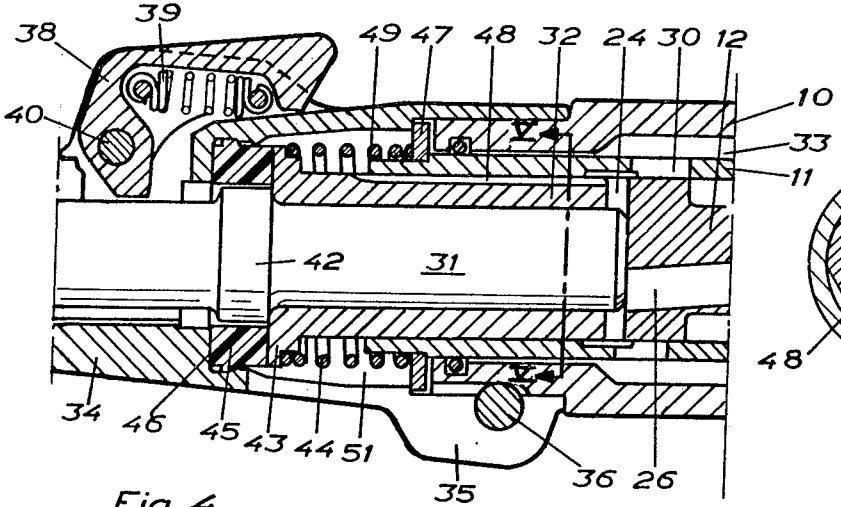
FIG. 4 shows, in larger scale, a longitudinal section of the front part of the tool in FIG. 3.

The thrust sleeve 32 is on its outside provided with three longitudinal flat portions (FIG. 5) which form air passages 48. (FIG. 4). These air passages 48 extend from the rear end of the sleeve 32 and have a length just to reach beyond the forward edge 49 of the cylinder 11 as the tool and, thereby spring 44, is unloaded. So, in the rest position of the tool, the air passages 48 are arranged to establish full communication between the forward cylinder chamber 24 and an annular space 51 inside the front part 34 of the housing 11. Space 51 communicates with the atmosphere via the slot 35 of the front part 34. However, if an axial load is applied on the tool housing 10, the thrust sleeve 32 is urged backwards against the action of spring 44 and the forward ends of the flat air passages 48 are choked by the forward edge 49 of the cylinder 11.

The operation order of the above described power tool is as follows:

As the nipple 15 is connected to a pressure air supply conduit and the working tool 31 is inserted through the front opening 37, the reciprocating motor is ready to be started by pressing the trigger 14. As the supply valve is opened by trigger 14, pressure air starts flowing through nipple 15 and reaches the rear cylinder chamber 21 via the supply chamber 20 and the openings 22 in the cylinder 11. The piston 12 thereby starts to reciprocate in the cylinder 11.

If there is no load applied on the tool housing 10 and, thus, no counter force is obtained from the working tool 31, the latter as well as the thrust sleeve 32 are urged to their forwardmost positions as illustrated in FIG. 4. The motor now runs under idle conditions which means that all energy developed in the motor has to be absorbed by the motor itself. However, severe stresses in the tool housing and other parts of the motor are effectively avoided in that the motor power is automatically reduced by the control device.

In absence of axial load on the motor, the thrust sleeve 32 occupies its forwardmost position in which the forward ends of the air passages 48 are situated in front of the cylinder edge 49. Thus, the passages 48 are uncovered and establish full communication between the forward cylinder chamber 24 and the atmosphere. As the air pressure in the forward cylinder chamber 24 is continuously released as described, the reciprocating power developed by the piston 12 is effectively reduced.

A further reduction of the piston energy is obtained by a drastic limitation of the air flow increase by means of the pressure recovering air supply restriction in nipple 15. In combination, the release of air pressure and the air flow restriction results in a decisive pressure drop within the motor, which means a considerable power reduction.

The remaining energy is easily transferred to the housing 10 via the thrust sleeve 32 and the resilient ring 45.

The described idle running conditions are illustrated by point $A_5$ in the diagram in FIG. 2. So, the fully open pressure release valve has a cross section represented by the point $A_5$ on the $P_2/q$ curve. As being apparent from the diagram, the pressure drop relative to full working pressure is very big.

As an axial load is successively applied on the tool, the working implement 31 and the thrust sleeve 32 are pressed backwardly relative to the housing 10 and the cylinder 11. Thereby, the outlet ends of the air release passages 48 are successively covered by the forward cylinder edge 49, the total pressure air release area is reduced, and the operation condition of the motor is moved from what is represented by point $A_5$ to $A_4$, to $A_3$, to $A_2$ and to $A_1$ as illustrated in the diagram in FIG. 2.

So, by means of the control device according to the present invention, it is possible to accurately adapt over a wide range the developed motor power to the load applied on the motor.

The invention is not limited to the shown and described example, but can be freely varied within the scope of the claims.

I claim:

1. A power control device for gradually changing the power developed by a pneumatic impact motor in response to the load applied on the motor housing through a working implement connected to the motor, the impact motor comprising a housing (10); a motor cylinder (11) in said housing; a motor piston (12) reciprocably mounted in the motor cylinder (11); means on said housing for receiving a working implement such that said working implement is movable axially relative to said cylinder and is in communication with said motor piston; and a pressure air supply passage (20) leading from a source of pressure air supply to the motor cylinder (11), the power control device comprising the combination of:

an inlet flow limiting means (15) located in the inlet portion of the pressure air supply passage (20) of the motor, said inlet flow limiting means (15) comprising a flow restriction (18) provided with a diverging pressure recovering outlet; and a motor load responsive pressure relief means located downstream of said flow limiting means (15) and coupled to the motor, said motor load responsive pressure relief means comprising a first member associated with the motor housing; a second member coupled to the working implement and being sealingly slidable in said motor cylinder (11) relative to said first member; a spring acting between said first and second members to balance the load applied on the motor; and at least one air relief opening in one of said first and second members and in communication with the interior of said motor cylinder (11), said at least one air relief opening being arranged to be controlled by an edge on the other of said first and second members such that said at least one opening is gradually uncovered by said edge due to relative movement of said first and second members responsive to the load applied on the motor housing relative to the working implement and second member being gradually decreased from maximum to zero for selectively and gradually releasing pressure air from said motor cylinder (11) to the atmosphere in response to and as a function of decreasing load applied on the motor housing relative to the working implement.

2. Control device according to claim 1, wherein said motor cylinder (11) includes at least one working chamber (24), and wherein said motor load responsive pressure relief means (48, 49), is connected to said at least one working chamber (24) to release pressure from said working chamber responsive to said decreasing motor load.

3. Control device according to claim 2, wherein said motor cylinder (11) comprises two working chambers (24, 21) located at opposite ends of said piston (12), and wherein said motor load responsive pressure relief means (48, 49) is connected to one of said working chambers (24) to release said pressure from said one working chamber responsive to said decreasing motor load.

4. Control device according to claim 3 wherein said spring biases said first and second members towards a relative position wherein said at least one opening is uncovered, said spring yielding responsive to a force resulting from the load applied on the motor.

5. Control device according to claim 4, wherein said motor housing is arranged to receive and support the rear end portion of the working implement, and said motor further including force applying means responsive to the axial load applied on the motor housing relative to the working implement for causing said spring to be yieldable by the axial load applied on the motor housing during working.

6. Control device according to claim 5, wherein said second member comprises an axially displaceable thrust sleeve surrounding and axially bearing against the rear end portion of the working implement, said thrust sleeve being provided with said at least one air relief opening in the form of air passages which are arranged to be closed as a result of axial displacement of said sleeve.

7. Control device according to claim 6, wherein said said cylinder has a forward end which comprises said first member, said forward end having a forward edge, and said thrust sleeve has a cylindrical outer surface slidably fitted in the forward end of said cylinder, said air passages being controlled by the forward edge of said cylinder.

8. Control device according to claim 7, wherein said air passages comprise flats on said cylindrical outer surface of said thrust sleeve, said flats extending from the rear end of said thrust sleeve to an axial level beyond the forward edge of said cylinder when the motor is not exposed to any axial load relative to the working implement.

9. Control device according to claim 1 or 2 wherein said spring (44) biases said first and second members towards a relative position wherein said at least one opening is uncovered, said spring yielding responsive to a force resulting from the load applied on the motor.

10. Control device according to claim 9, wherein said motor housing is arranged to receive and support the rear end portion of the working implement, and said motor further including force applying means responsive to the axial load applied on the motor housing relative to the working implement for causing said spring to be yieldable by the axial load applied on the motor housing during working.

11. Control device according to claim 10, wherein said second member comprises an axially displaceable thrust sleeve surrounding and axially bearing against the rear end portion of the working implement, said thrust sleeve being provided with said at least one air relief opening in the form of air passages which are arranged to be closed as a result of axial displacement of said sleeve.

12. Control device according to claim 10, in which the motor housing is provided with a nipple for connection of a pressure air supply hose, and wherein said flow restriction is incorporated in said nipple.

13. Control device according to claim 1, wherein said first member of said motor load responsive pressure relief means comprises a forward end of said motor cylinder, said forward end of said motor cylinder having a forward edge; said second member of said motor load responsive pressure relief means comprises an axially displaceable thrust sleeve surrounding and axially bearing against the rear end portion of the working implement, said thrust sleeve comprising a plurality of said air relief openings therein, said plurality of air relief openings being gradually uncovered by said forward edge of said forward end of said motor cylinder responsive to said decreasing load applied on the motor housing relative to the working implement.

14. Control device according to claim 1 comprising a plurality of said air relief openings, said plurality of air relief openings being formed in said second member.

* * * * *